US009618904B2

(12) United States Patent
Meyer et al.

(10) Patent No.: US 9,618,904 B2
(45) Date of Patent: Apr. 11, 2017

(54) PLASTIC OR ELECTROFORMED WATCH CASE WITH REMOVABLE CRYSTAL

(71) Applicant: ETA SA Manufacture Horlogere Suisse, Grenchen (CH)

(72) Inventors: Vincent Meyer, Biel/Bienne (CH); Thierry Altenhoven, Zollikofen (CH); Ines Rustenberg, Riedholz (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/014,774

(22) Filed: Feb. 3, 2016

(65) Prior Publication Data

US 2016/0252882 A1 Sep. 1, 2016

(30) Foreign Application Priority Data

Feb. 27, 2015 (EP) ..... 15156978

(51) Int. Cl.
*G04B 39/02* (2006.01)
*G04B 37/00* (2006.01)
(Continued)

(52) U.S. Cl.
CPC ..... *G04B 37/0008* (2013.01); *G04B 37/11* (2013.01); *G04B 37/225* (2013.01);
(Continued)

(58) Field of Classification Search
CPC ..... G04B 37/225; G04B 39/02; G04B 37/11; G04B 39/00; G04B 43/00; G04B 37/0008; G04B 37/226; G04B 39/004
(Continued)

(56) References Cited

U.S. PATENT DOCUMENTS 3,261,159 A * 7/1966 Simon ..... G04B 37/081 368/291
3,386,239 A 6/1968 Shiffman
(Continued)

FOREIGN PATENT DOCUMENTS

EP 0 272 515 B1 6/1988
EP 0 621 518 A1 10/1994
(Continued)

OTHER PUBLICATIONS

European Search Report issued Nov. 9, 2015 in European application 15156978, filed on Feb. 27, 2015 (with English Translation).

*Primary Examiner* — Sean Kayes
(74) *Attorney, Agent, or Firm* — Oblon, McClelland, Maier & Neustadt, L.L.P.

(57) ABSTRACT

A watch case includes a case middle made of plastic or electroformed material and a crystal. The crystal or the case middle includes elbowed catches that are each insertable in a bayonet fitting in a recess of the case middle or the crystal. The case also includes a rotation stop angularly securing the case middle and the crystal in an angular position such that a part of each catch is frontally locked behind a holding surface of the case middle or of the crystal. The rotation stop is frontally snap-fitted on the case middle and/or the crystal by snap-fit fingers that cooperate with a complementary stop surface of the case middle and/or of the crystal.

12 Claims, 10 Drawing Sheets

(51) Int. Cl.

| | |
|---|---|
| ***G04B 37/11*** | (2006.01) |
| ***G04B 37/22*** | (2006.01) |
| ***G04B 39/00*** | (2006.01) |
| ***G04B 43/00*** | (2006.01) |

(52) U.S. Cl.
CPC ..... *G04B 37/226* (2013.01); *G04B 39/00* (2013.01); *G04B 39/004* (2013.01); *G04B 39/02* (2013.01); *G04B 43/00* (2013.01)

(58) Field of Classification Search
USPC ..... 368/309, 296
See application file for complete search history.

(56) References Cited

U.S. PATENT DOCUMENTS 4,322,834 A 3/1982 Schaeren et al.
4,327,429 A * 4/1982 Klingenberg ..... G04B 37/0008 368/294
4,397,567 A * 8/1983 Carl ..... G04B 37/225 368/292
4,627,738 A * 12/1986 Kao ..... G04B 37/0008 368/281
4,845,694 A * 7/1989 Vuilleumier ..... G04C 10/00 368/309
5,005,161 A * 4/1991 Boilen ..... G04B 47/046 368/295
5,490,123 A 2/1996 Biver
6,084,504 A * 7/2000 Rosche ..... A61J 7/0472 222/638
6,406,178 B1 * 6/2002 Luscher ..... G04B 37/0008 368/286
6,655,831 B1 * 12/2003 Ruffieux ..... G04B 37/116 368/281
7,399,114 B2 * 7/2008 Hiranuma ..... G04B 37/08 368/294
2009/0073816 A1 * 3/2009 Ozawa ..... G04B 37/05 368/294
2015/0043314 A1 * 2/2015 Hiranuma ..... G04B 3/048 368/308
2016/0098013 A1 * 4/2016 Kadmiri ..... G04B 19/283 368/273

FOREIGN PATENT DOCUMENTS

EP 1 249 741 A1 10/2002
FR 2 431 721 2/1980

* cited by examiner

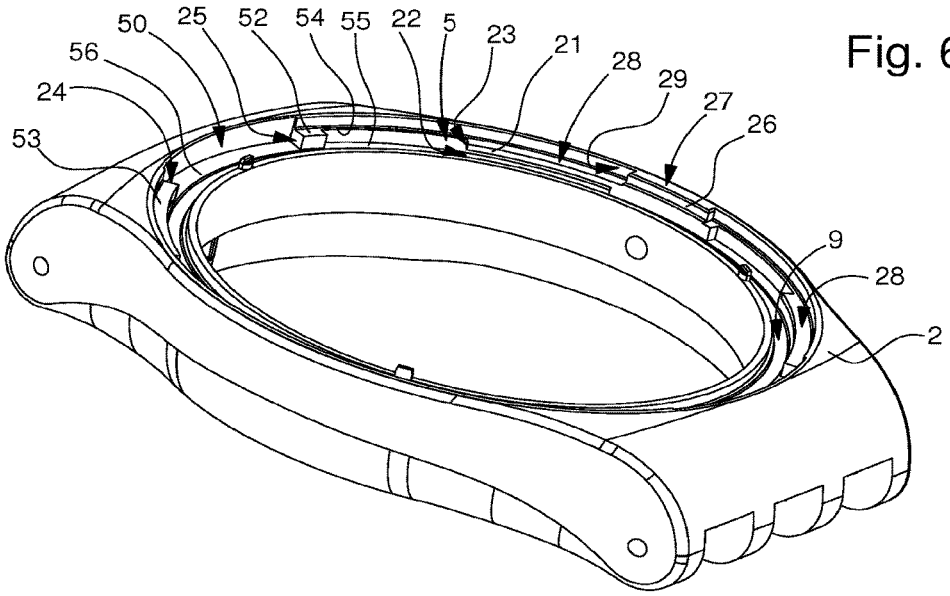
Fig. 6
Fig. 7
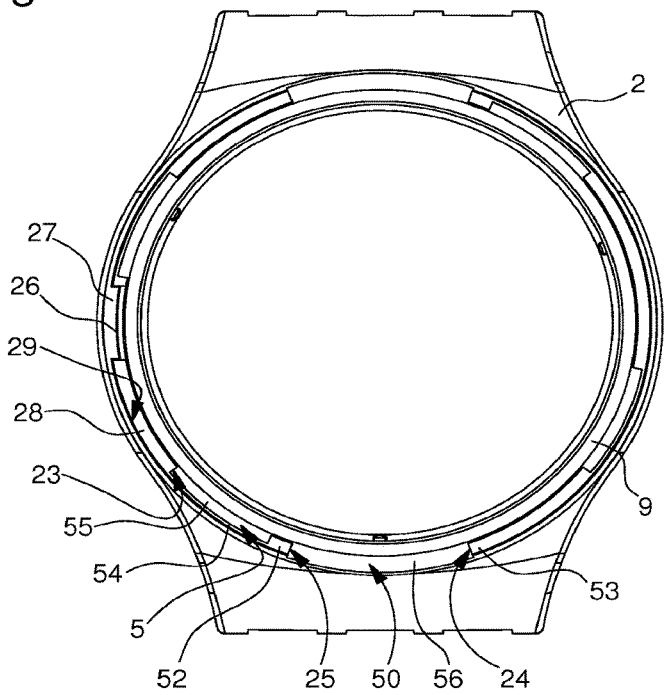

Fig. 15 A-A
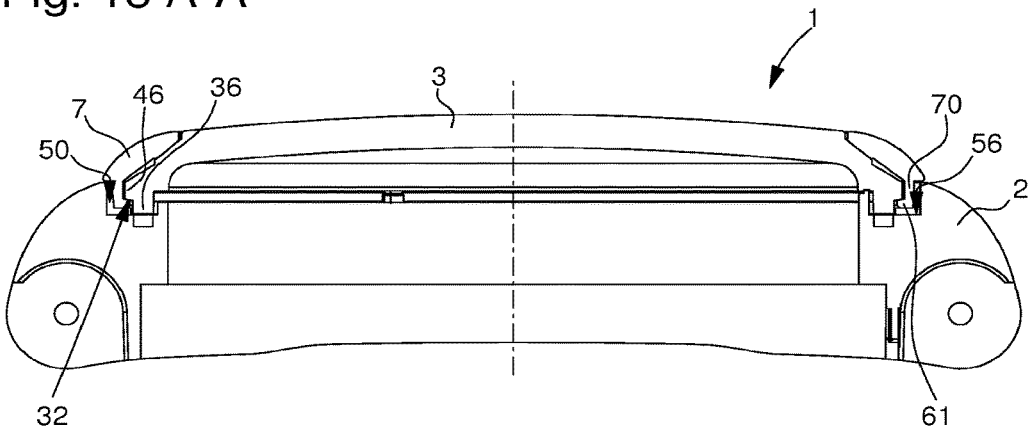
Fig. 15 B-B
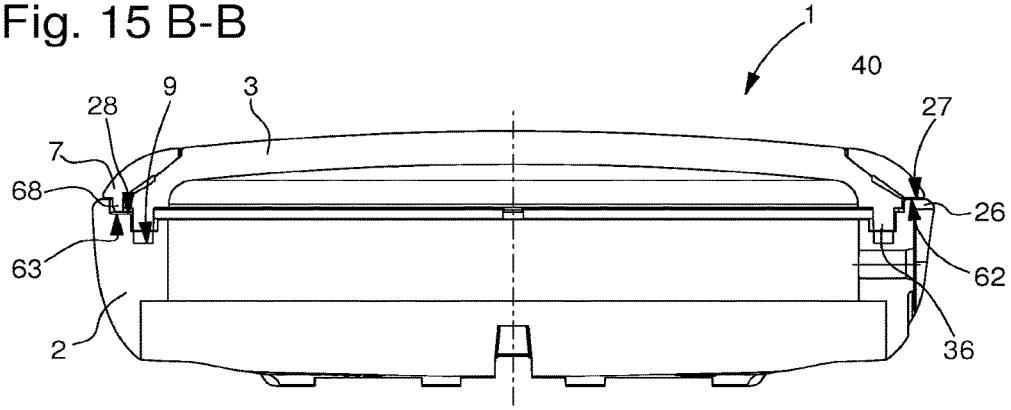
Fig. 15 C-C
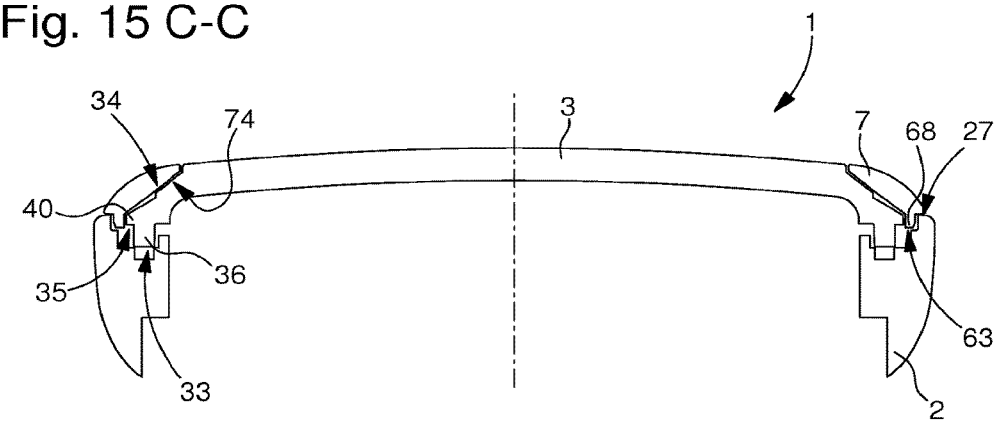

Fig. 15 D-D
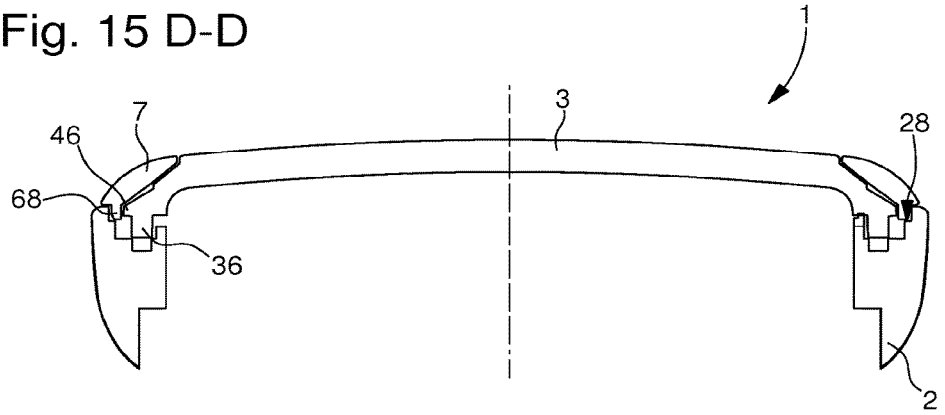
Fig. 15 E-E
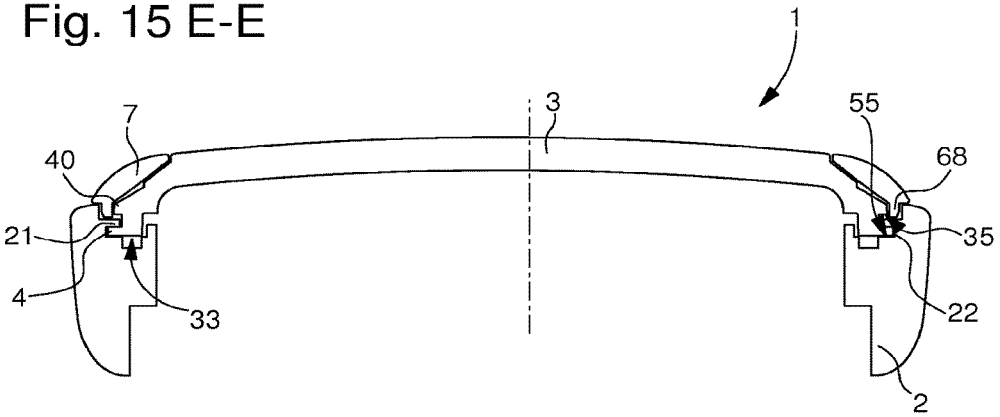
Fig. 15 F-F
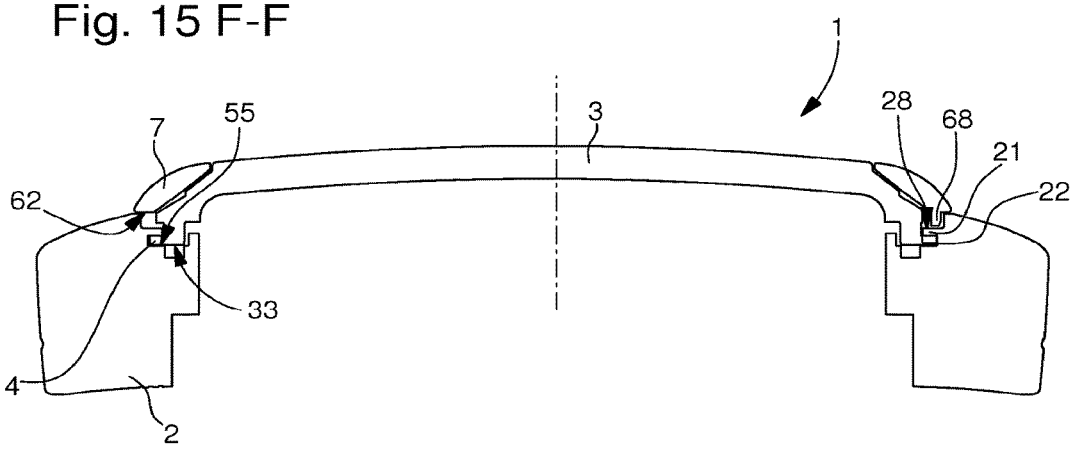

Fig. 15 G-G
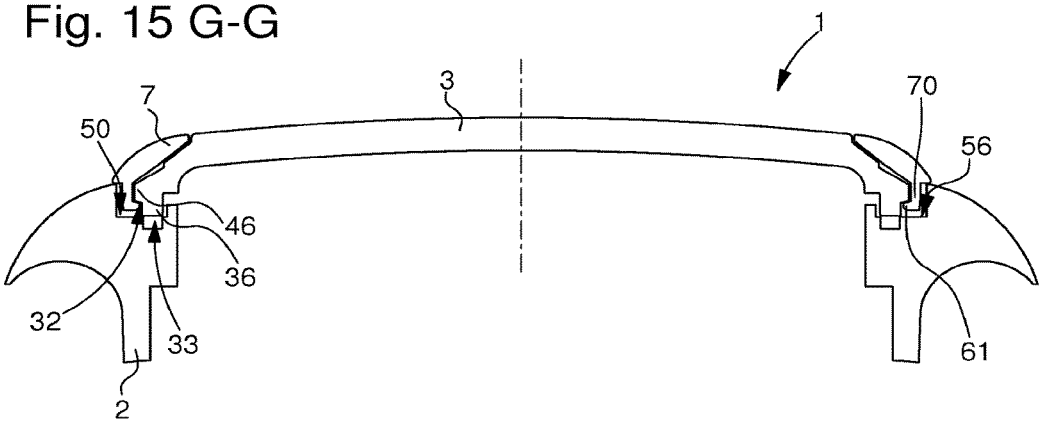
Fig. 15 H-H
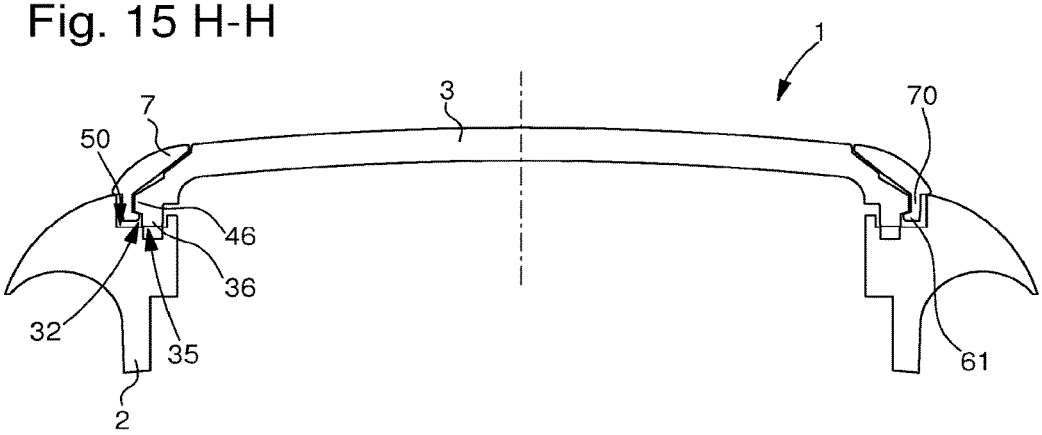
Fig. 15 I-I
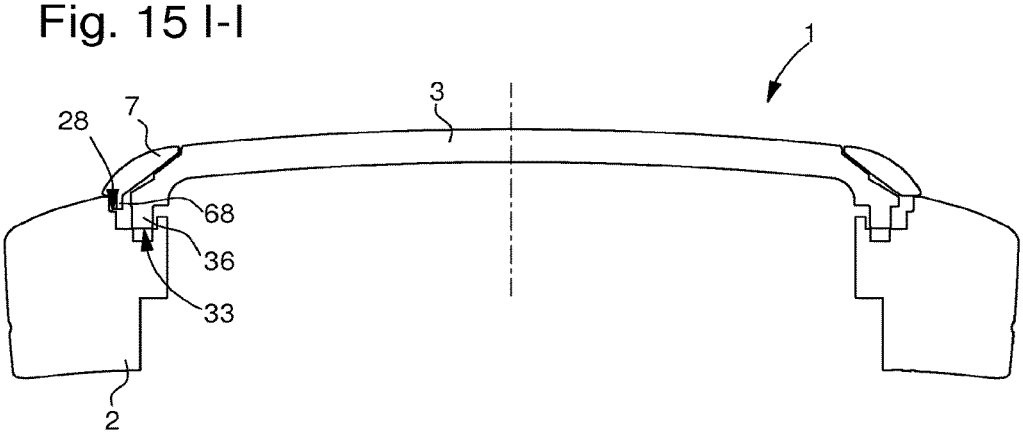

Fig.15 J-J
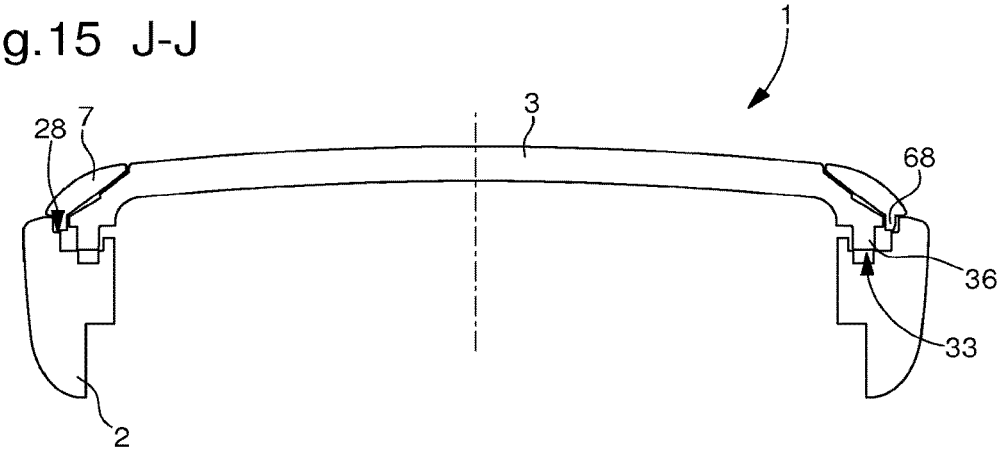
Fig. 15 K-K
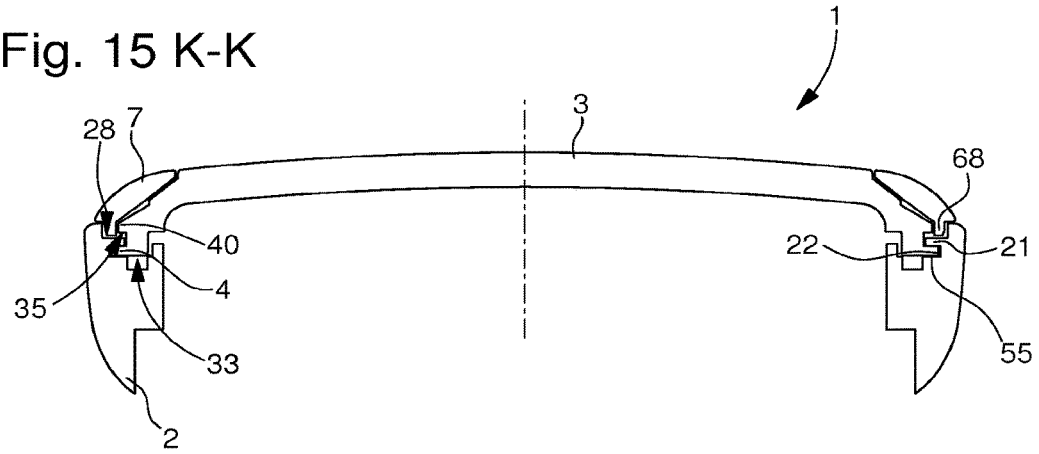
Fig. 15 L-L
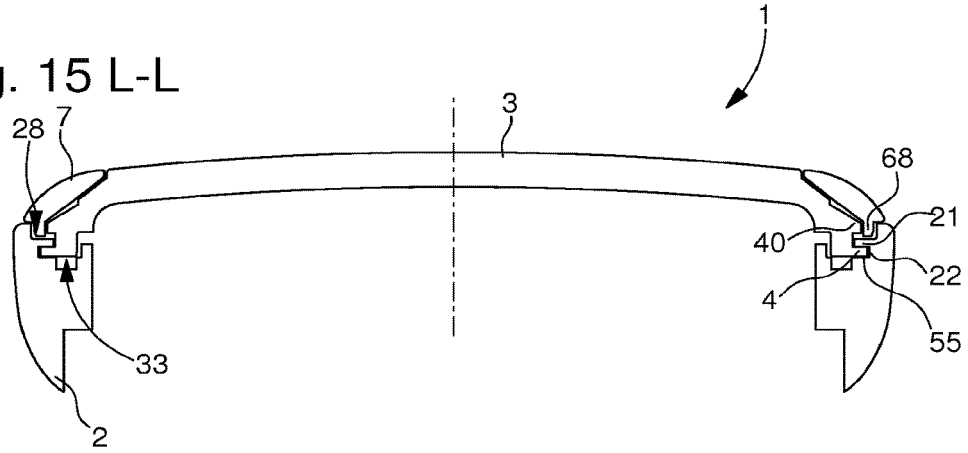

PLASTIC OR ELECTROFORMED WATCH CASE WITH REMOVABLE CRYSTAL

This application claims priority from European Patent Application No. 15156978.7 filed Feb. 27, 2015, the entire disclosure of which is incorporated herein by reference.

FIELD OF THE INVENTION

The invention concerns a watch case, comprising a case middle made of plastic or electroformed material and a removable crystal.

The invention also concerns a watch including a case of this type.

The invention concerns the field of the protection of timepiece movements, and more specifically watch cases.

BACKGROUND OF THE INVENTION

When, in a watch, a component such as the crystal, or the back crystal, or the back cover, is required to be removable, this component is generally fitted onto the case middle or the case by means of a ring. This type of attachment is only possible when the case middle or case is made of metal. Indeed, if it is made of plastic, the material will creep under the stress exerted by the ring, and the component will fall off by itself.

It is known to use an additional metal piece to stiffen the case middle/case at the point of contact between the component and the case middle/case. However, the space available often prevents the addition of such a metal stiffener.

U.S. Pat. No. 3,386,239 in the name of SHIFFMAN discloses a watch case made of plastic material receiving a crystal mounted thanks to a bayonet fitting.

SUMMARY OF THE INVENTION

The invention proposes to avoid the use of such an additional metal piece. To this end, the invention concerns a watch case according to claim 1.

The invention also concerns a watch including a case of this type.

BRIEF DESCRIPTION OF THE DRAWINGS

Other features and advantages of the invention will appear upon reading the following detailed description, with reference to the annexed drawings, in which:

FIG. 1 shows a case middle and a crystal intended to be secured in a bayonet fitting on the case middle, in a presentation position prior to insertion of the crystal in the case middle.

FIG. 2 shows the same sub-assembly after application of a frontal force F, with the crystal in the first angular position of insertion or of removal with respect to the case middle, and pressed therein.

FIG. 3 shows the same sub-assembly after application of a rotation R, the crystal is then in a second angular holding position relative to the case middle.

FIG. 4 shows the same sub-assembly, supplemented by a rotation stop means according to the invention, formed here by a bezel intended to be snapped into case middle to lock the crystal in position, with the bezel shown in a position prior to insertion.

FIG. 5 shows the same assembly, with the bezel snapped into position in the case middle.

FIG. 6 shows a schematic perspective view of the case middle of the assembly of FIG. 5, with recesses for the insertion of catches of the crystal, and housings provided for insertion of snap-fit tabs of the bezel.

FIG. 7 is a plan view of the case middle of FIG. 6, on the side of the crystal bearing surfaces, and of these recesses and housings.

DETAILED DESCRIPTION OF PREFERRED EMBODIMENTS

Figures 1, 2, 3, 4, 5:
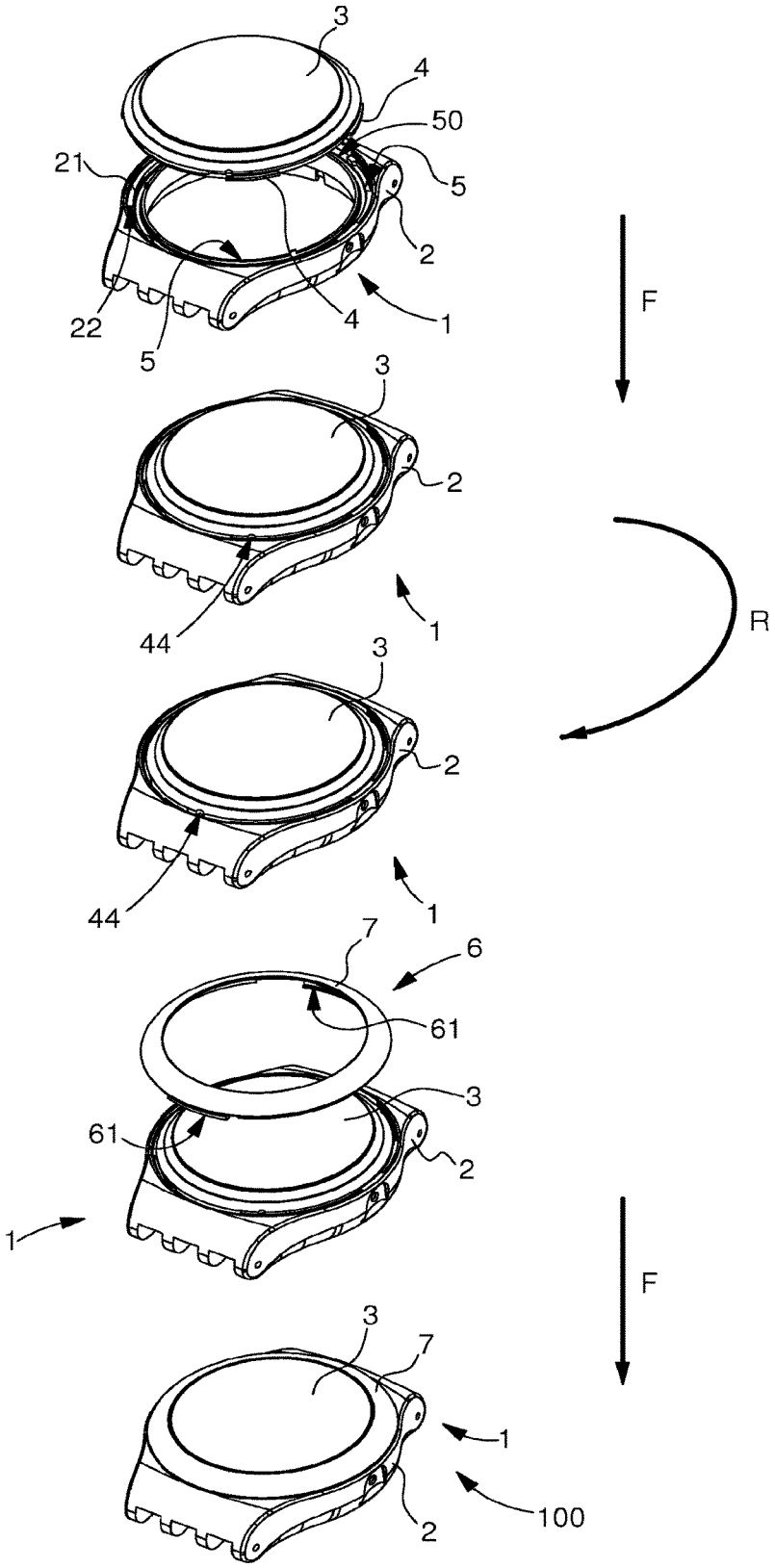
FIGS. 1 to 5 illustrate, in schematic perspective views, the assembly sequence of a case middle, a crystal, and a bezel, comprised in a watch case according to the invention.

The invention concerns a watch case 1, comprising a case middle 2, preferably made of plastic or electroformed material or of thin section, and a removable crystal 3. The term "crystal" is a generic term here that can designate a crystal or glass, a back crystal, a back cover or any similar component fixed on the case middle.

The invention consists in rendering crystal 3 removable, without using an additional metal piece to stiffen the case middle/case. To achieve this, crystal 3 is mounted in a bayonet fitting, vertically held, and a snap-fitting secures rotation stop means 6, which prevents crystal 3 from rotating relative to case middle 2.

According to the invention, this crystal 3, or respectively case middle 2, comprises a plurality of elbowed catches 4, each frontally insertable in a corresponding recess 5 comprised in correspondence in case middle 2 or respectively crystal 3, in a first relative angular position between case middle 2 and crystal 3 called the first position of insertion or of removal.

In a non-illustrated variant, crystal 3 and case middle 2 can each comprise both catches 4 and recesses 5. Those skilled in the art will know how to extrapolate the characteristics of the present description, which concerns the simple case, illustrated by the Figures, wherein only crystal 3 comprises catches 4, and wherein only case middle 2 comprises recesses 5.

Catches 4 may adopt various configurations, and notably:

- in the variant illustrated by the Figures, these catches 4 are lugs extending substantially radially, in one plane, away from the centre of crystal 3;
- in another non-illustrated variant, the catches extend substantially in a tangential plane to the edge of crystal 3, and are hook-shaped.

Each such catch 4 is arranged to occupy, in the first angular position of insertion or removal, a first pressed-in position in a recess 5, when the distance between case middle 2 and crystal 3 is minimal.

Case middle 2 and crystal 3 are arranged to pivot with respect to each other, in this first pressed-in position of catches 4, to a second angular holding position, where one portion, depending on the case either lug or elbow, of each catch 4 is frontally locked behind a holding surface forming a safety catch comprised in case middle 2 or respectively crystal 3.

FIG. 6 illustrates a dividing wall 21 of case middle 2, which thus locks a lug forming catch 4 of crystal 3, after the bayonet mounting thereof in a groove 22 which is delimited at the same time on an upper side, by dividing wall 21, and on the other lower side by a lower bearing surface 55 of case middle 2 and peripherally by a surface 54. Dividing wall 21 ends on an end surface 23 at recess 5. The recess is limited on the side opposite groove 22 by a protruding portion 52. The top of dividing wall 21 forms an intermediate bearing surface 28 which is limited peripherally by a surface 29, and arranged to cooperate with certain portions of crystal 3. Beyond that, an upper bearing surface 27 of case middle 2 is arranged to cooperate with certain portions of a bezel 7. This intermediate bearing surface 28 is interrupted by a solid portion 26, which also forms the bottom of groove 22.

In a particular embodiment, the cooperation between at least one catch 4 and one corresponding dividing wall 21 is accompanied by an elastic deformation of at least one of these two components, so as to exert friction to maintain the position, in the absence of any particular stress. This cooperation may also include cooperation between a catch and a notch, or between complementary surfaces in a similar manner, for indexing in the second angular holding position, and/or a brake requiring the application of a higher torque during disassembly.

In a particular variant, catch 4 (and/or the corresponding dividing wall 21) is rippled, or notched, or fluted or similar.

Figure 9:
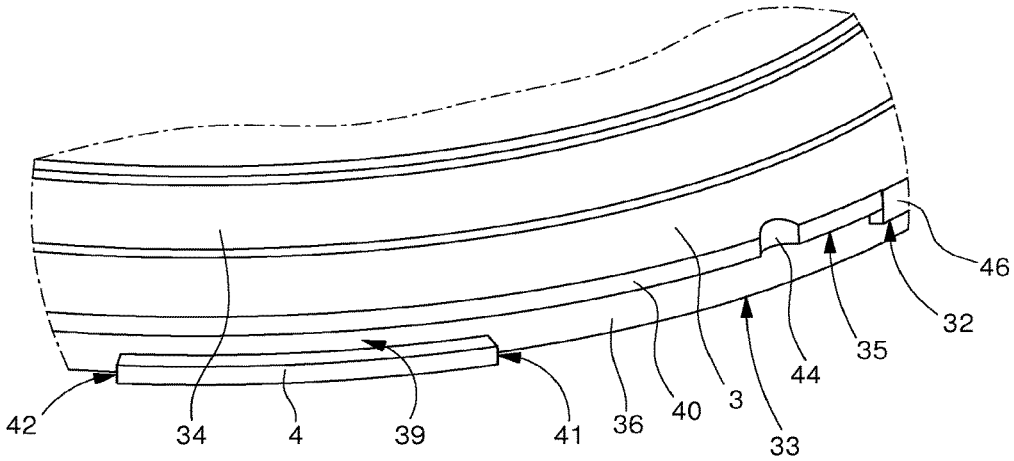
FIG. 9 shows a schematic perspective view of a detail of the crystal of the assembly of FIG. 5; there is shown a radially projecting catch, intended to be engaged in a recess of the case middle, surmounted by a narrow peripheral first rib, which carries an operating notch, and which includes a lower first surface, and which is extended by a wide peripheral second rib, which includes a lower second surface intended to receive in abutment snap-fit fingers of the bezel.

Lug 4 includes at least one end surface 41, 42, visible in FIG. 9, forming, in one variant, an angular stop member for crystal 3 on case middle 2, in the bottom 51 of groove 22.

This arrangement ensures the proper relative static holding of crystal 3 on case middle 2. However, the presence of vibrations, or a high acceleration situation, may means that this bayonet mounting is insufficient.

To this end, in an advantageous configuration specific to the invention, case 1 comprises a rotation stop means 6, which is arranged to angularly secure case middle 2 and crystal 3 in this second angular holding position.

Preferably, this rotation stop means 6 is arranged to allow easy disassembly of crystal 3 relative to case middle 2.

It is therefore impossible to use a pin or a key, which require a press-fit and a particular tool for disassembly, said disassembly also risking damage to one of the components.

Preferably, rotation stop means 6 is frontally snap-fitted on case middle 2 and/or crystal 3 by snap-fit means comprised in rotation stop means 6. In the illustrated variant, these snap-fit means are snap-fit fingers 61, at the distal end of resilient tabs 70, and which are arranged to cooperate with at least one complementary stop surface, or with complementary snap-fit fingers, comprised in case middle 2 and/or crystal 3. In the illustrated variant, snap-fit fingers 61 cooperate in abutment with a lower second surface 32 comprised in a wide peripheral second rib 46 of crystal 3. This lower second surface 32 may advantageously comprise a complementary relief to that of snap-fit finger 61; it may also consist of the surface of a resilient element participating in the snap-fit, in addition to the resilience specific to snap-fit tabs 70.

In an advantageous variant, rotation stop means 6 is made of plastic material.

In a preferred variant illustrated by the Figures, rotation stop means 6 is a bezel 7. This bezel 7 is preferably placed both on middle part 2 and on glass 3.

Although the invention is illustrated in a configuration in which crystal 3 is, in a conventional manner, a crystal covering the main display on a front surface of the watch, it is understood that the invention may be used for the back surface of the watch. Also, the component referred to here as "crystal 3" may be formed by a back crystal, or by an opaque back cover, or other element.

In a variant, crystal 3 is made of plastic material.

Although the invention is preferably, but not restrictively, intended for plastic case middles, since it has the advantage of preventing the deformation or even breakage of such case middles during assembly of a crystal or suchlike, it is also highly applicable to electroformed case middles of small section, notably close to 0.5 mm or less than this value, and in particular to 18 carat gold alloy case middles having a section of 0.5 mm.

The invention is also advantageous for assembling a crystal 3 made of a material that is also sensitive to press-fit stresses, such as a crystal made of plastic material, or an electroformed back cover, or other element.

Preferably, the second angular holding position is delimited by first angular stop means, comprised in case middle 2, which are arranged to cooperate in abutment with complementary first angular stop means, comprised in crystal 3. Thus, the bottom 51 of groove 22 of case middle 2, forming these first angular stop means, is arranged to cooperate in abutment with a complementary stop surface 42 of catch 4 of crystal 3, forming these first complementary angular stop means. A complementary stop surface 45 comprised in wide peripheral second rib 46 of crystal 3 may also cooperate in abutment with an edge of solid part 26 of case middle 2.

Rotation stop means 6 advantageously comprises second angular stop means, which are arranged to cooperate in abutment with complementary second angular case middle stop means, comprised in case middle 2, and/or with complementary second angular crystal stop means, comprised in crystal 3. In the illustrated variant, the lateral edges 66, 67 of snap-fit fingers 61 form these second angular stop means, and are arranged to limit the angular clearance of bezel 7 with respect to lateral surfaces 24, 25 of housings 50 of case middle 2, which form these complementary angular case middle stop means. These edges 66 and 67 are arranged to prevent pivoting of crystal 3 once the bezel is snap-fitted in position: they form stop members for end surfaces 41, 42 of catches 4. Naturally, the bezel could comprise separate angular stop surfaces, but it is simpler to use snap-fit tabs 70 and snap-fit fingers 61 performing both the snap-fit and angular position holding functions.

The border 68 rests, via its rim 63, on intermediate bearing surface 28 of case middle 2 and the edges of this border 68 may cooperate in abutment with the edges of solid portions 26, 53 of case middle 2. Bezel 7 may also comprise protruding, or respectively recessed portions, relative to its truncated cone area 74, which cooperates with defined circumferential play with recessed, respectively protruding portions comprised in the truncated cone portion 34 of crystal 3.

In the variant of the Figures, in the pressed-in first position, when the distance between case middle 2 and crystal 3 is minimal, case middle 2 and crystal 3 together compress at least one sealing gasket, not shown in the Figures, housed in a groove 9 comprised in case middle 2 and/or crystal 3.

The Figures illustrate a particular embodiment which is not limiting.

FIGS. 1 to 5 show the assembly kinematics, the disassembly kinematics being symmetrical.

FIG. 1 shows the presentation of catches 4 of crystal 3 facing the notches forming recesses 5 of case middle 2. Sectors having shape of revolution are visible forming dividing walls 21 of case middle 2, delimiting grooves 22 for locking catches 4. Case middle 2 comprises, on these dividing walls, the bottom of the groove, or the solid portion, end surfaces 23, 25, 51 arranged to abuttingly engage with complementary stop surfaces 41, 42, 45 of crystal 3. Preferably, the relative cooperation in a bayonet fitting of case middle 2 and crystal 3 occurs in only one direction, stopping in position can then be achieved simply with one end surface 51 and one complementary stop surface 42.

Application of a frontal force F on crystal 3 achieves the pressed-in first position of catches 4, seen in FIG. 2.

The application of a pivoting torque on crystal 3 secures the bayonet mount, and the cooperation of catches 4 with grooves 22 and the respective dividing walls 21. Case 1 can then be used.

Figure 15:
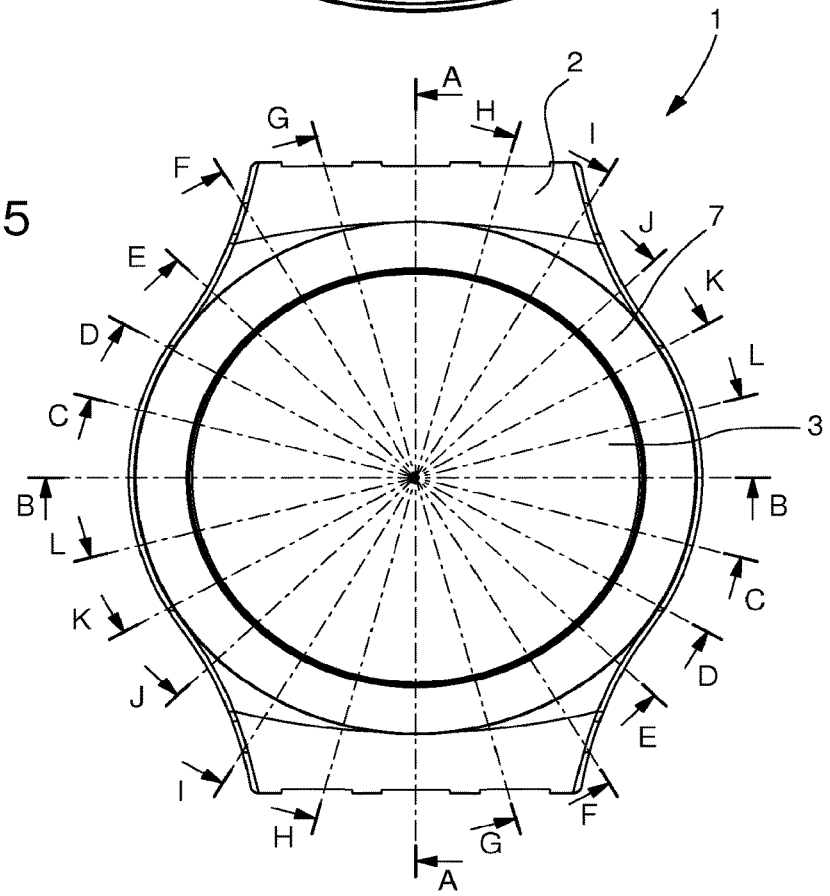
FIG. 15 shows a schematic plan view from the top side where the crystal is visible, of the assembly of FIG. 5, with 12 sections referenced AA to LL, passing through the same main axis of the case, and illustrating the corporation, in the different areas, between the case middle, the crystal, and the bezel, and FIGS. 15A-A to 15 L-L show these various sections.

FIG. 4 shows the preferred embodiment, wherein a bezel 7, provided with tabs 70 including snap-fit fingers 61, forms rotation stop means 6. Case middle 2 includes housings 50, which are arranged to allow insertion of tabs 70 and of snap-fit fingers 61. As seen in the sections of FIG. 15, these snap-fit fingers 61 cooperate in a snap-fit arrangement with a back surface 32 comprised in crystal 3.

It is, of course, possible also to provide other back surfaces, on case middle 2, cooperating then with other dedicated snap-fit fingers.

The application of a frontal force F on bezel 7 allows it to be snap-fitted on case middle 2, as seen in FIG. 5.

Figure 8:
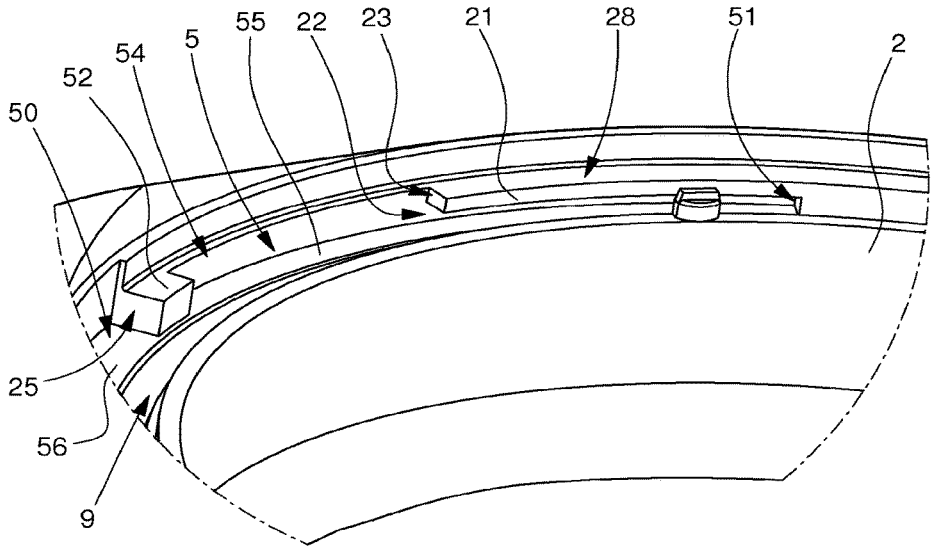
FIG. 8 shows a schematic perspective view of a detail of the case middle of FIG. 6, showing an axial recess for insertion of a crystal catch, substantially parallel to the main axis of the watch and perpendicular to the plane tangent to the case middle at the centre thereof, which is extended tangentially by a chamber for receiving and locking a crystal catch; the upper portion of this chamber is delimited by a dividing wall, and the lower portion by a lower bearing surface of the case middle; the top of the dividing wall forms an intermediate bearing surface arranged to cooperate with certain parts of the crystal, and, beyond that, an upper bearing surface of the case middle is arranged to cooperate with certain parts of the crystal.

FIGS. 6 to 8 show details of case middle 2 and its recesses 5, and housings 50, located between projecting portions 52 or solid portions 53 or 26, and bordered laterally by end surfaces 23, 25 for guiding tabs 70 during insertion of bezel 7, and at the bottom by a bottom surface 56 which may be at the same level as bottom surface 55 of recesses 5 as seen in the Figures.

Figure 10:
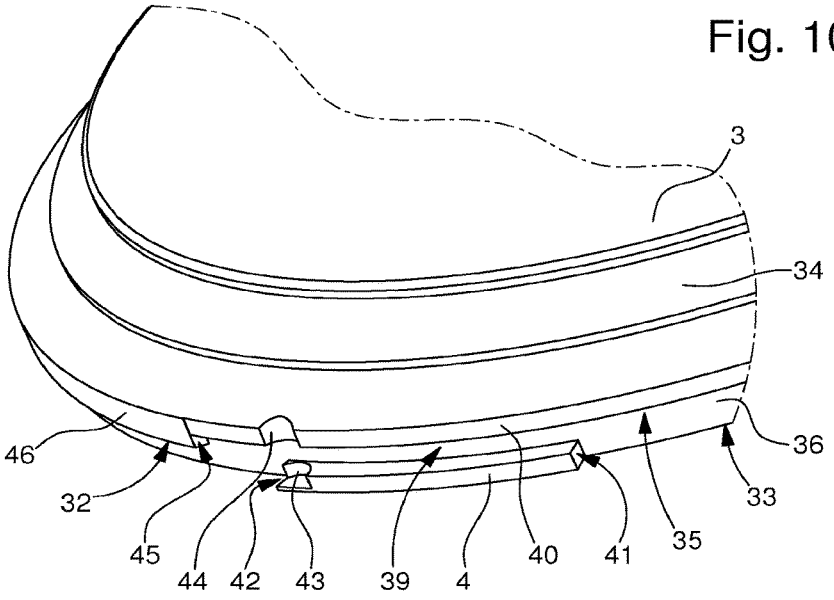
FIG. 10 shows another detail of the same crystal, the particular assembly illustrated by the Figures being devised for only one relative orientation between the watch case components; the narrow peripheral first rib visible in this detailed view bears a cavity in the extension of the operating notch.
Figure 11:
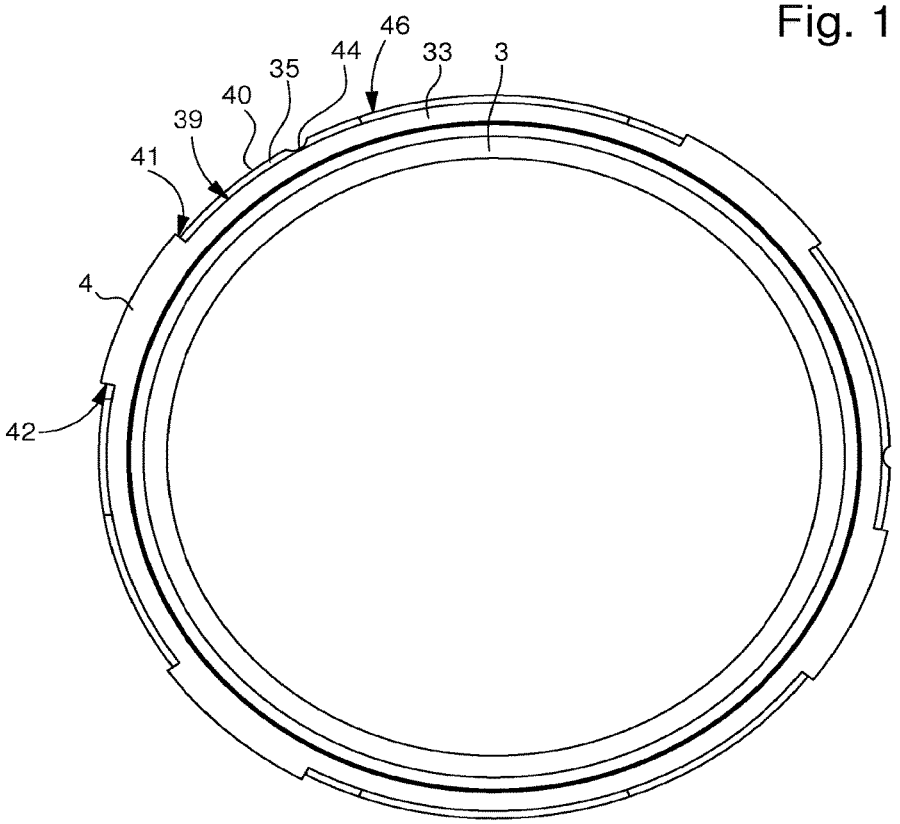
FIG. 11 is a plan view of the crystal of FIGS. 9 and 10, from the lower side which includes the catches.

FIGS. 9 to 11 show a crystal 3, with, around the central functional portion for display and closure, a truncated cone portion 34, surrounded by a rim 36, ending in a lower surface 33 which is flat here. Crystal 3 includes 4 catches 4 in the form of flat lugs. Crystal 3 may also include flat portions, or here notches 44, forming a support for a screwing or unscrewing tool, and facilitating injection moulding? of crystal 3 with its catches 4 or lugs.

This catch 4, projecting radially from rim 36, is surmounted by a narrow peripheral first rib 40, which comprises a lower first surface 35, and which is extended by a wide peripheral second rib 46, which includes a lower second surface 32 on which snap-fit fingers 21 of bezel 7 are snapped. Catch 4 and narrow peripheral first rib 40 delimit together a groove 39. Catches 4, narrow peripheral first ribs 40 and wide peripheral second ribs 46 are substantially parallel.

FIG. 10 shows an end face 45 of a wide peripheral second rib 46. Narrow peripheral first rib 40 bears a cavity 43 in the extension of operating notch 44.

Figure 12:
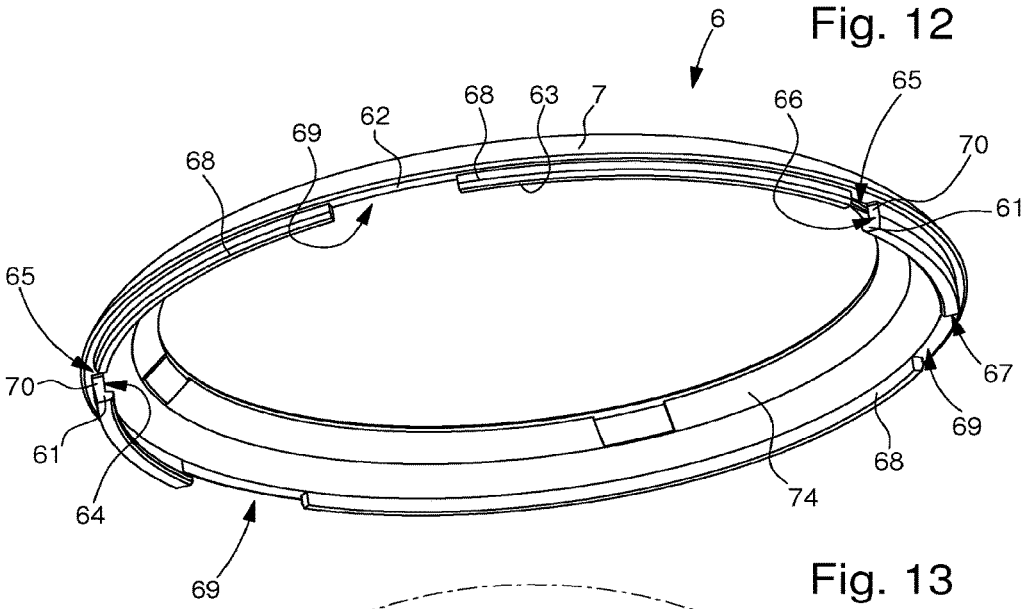
FIG. 12 shows a schematic perspective view of a bezel of the assembly of FIG. 5, seen from the lower side which includes, on the one hand, snap-fit fingers intended to cooperate in abutment with the lower second surface of the wide peripheral second rib of the case middle, and on the other hand, a border for cooperation with the case middle.
Figure 13:
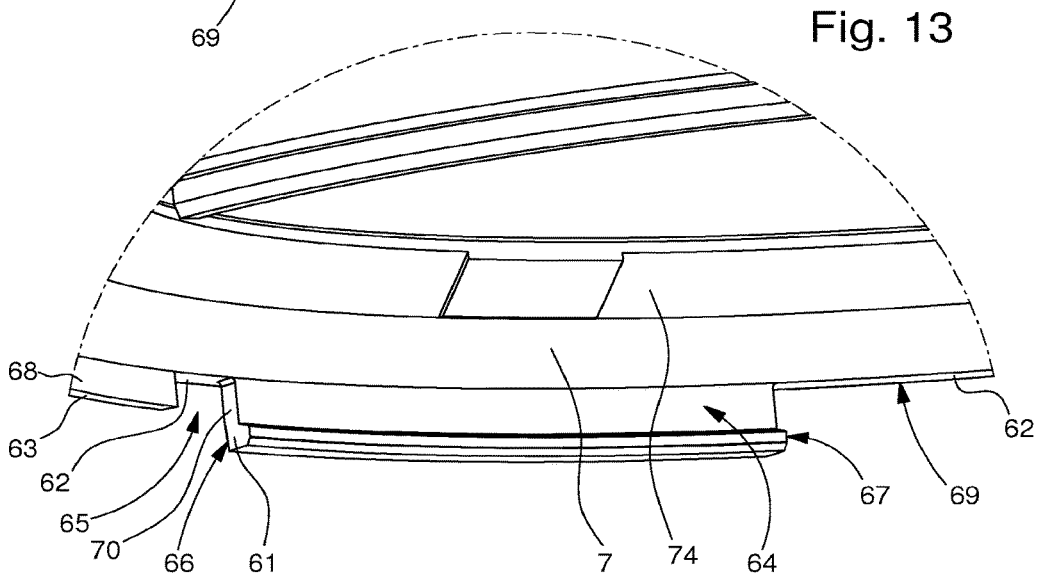
FIG. 13 shows a schematic perspective view of a detail of the bezel of FIG. 12, showing a snap-fit finger at the end of a tab.
Figure 16:
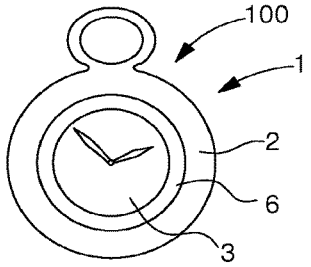
FIG. 16 shows a schematic view of a watch including a case of this type.
Figure 14:
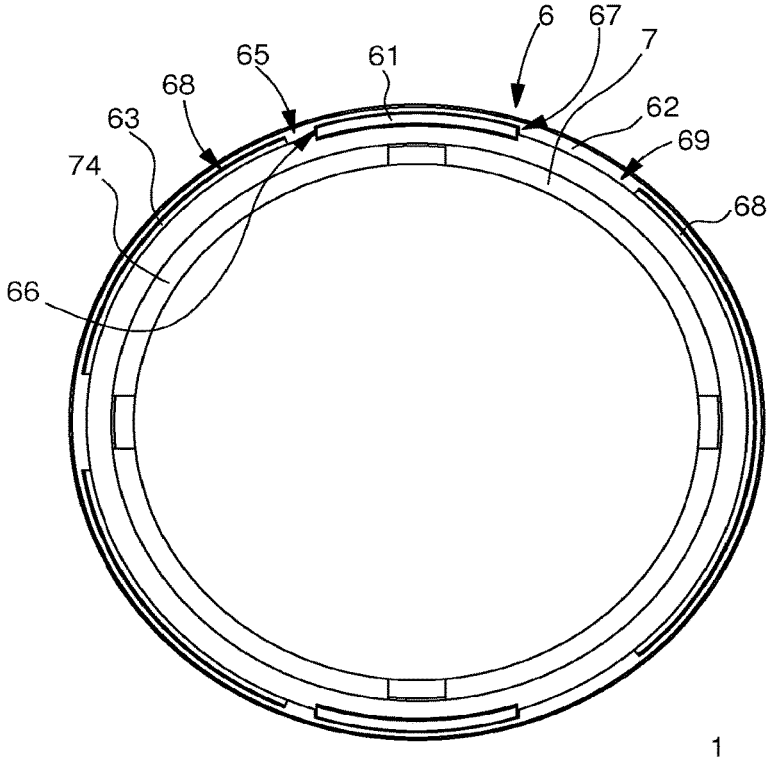
FIG. 14 is a plan view of the bezel of FIGS. 12 and 13, from the so-called lower side which includes the snap-fit fingers, and faces the case middle.

FIGS. 12 to 14 show a bezel 7 equipped with two tabs 70 provided with snap-fit fingers 61, the edges 66, 67 of these snap-fit fingers 61 are arranged to limit the angular clearance of bezel 7 relative to lateral surfaces 24, 25 of housings 50 of case middle 2. The rest of the periphery of bezel 7 includes border skirts 68 interrupted by passages 69, separated from tabs 70 by narrow passages 65 and wide passages 69, and comprising end surfaces forming angular stops. The bottom 62 of passages 65 and 69 forms a flat bearing surface. The edge 63 of borders 68 forms another flat bearing surface, parallel to the preceding bearing surface. Tabs 70 comprise, facing towards the centre, a substantially cylindrical surface 64. Bezel 7 also includes a truncated cone surface 74, arranged to cooperate with the corresponding truncated cone portion 34 of crystal 3.

The sections of FIGS. 15A-A to 15L-L show in detail the cooperation of the different surfaces in the assembled position of FIG. 5.

These sections show an optimal overlap between bezel 7, crystal 3 and case middle 2, to limit the introduction of humidity or foreign bodies into the case.

In particular, truncated cone surfaces 34 and 74 of the crystal and of the bezel are arranged with strictly complementary profiles. The snap-fit presses one onto the other with a clamping force ensuring continuous peripheral support.

On the portion of bezel 7 having the largest diameter, the bezel rests on upper bearing surface 27 of case middle 2 and consequently covers housings 50 and the snap-fit areas.

More particularly, the areas of snap-fit cooperation are seen in sections A-A, G-G, H-H. The corporation of catches 4 in grooves 22 are visible in sections E-E, F-F, K-K, L-L.

The other sections are not all exactly identical, since borders 68 are interrupted by passages 65 and 69, and bezel 7 abuts, depending on the case, on surface 27 of solid section 26, and/or on the intermediate bearing surface 28 of case middle 2. For example, in the right part of section B-B, bezel 7 abuts via its surface 62 on surface 27 of solid section 26, whereas in the left part, rim 63 of border 68 of bezel 7 also abuts on intermediate bearing surface 28 of case middle 2.

The axial and radial stepped arrangement of the various bearing surfaces 27, 28, 55, 56, and of the elements of case middle 2 (ribs 21, solid parts 26, and 53, protuberances 52), combined with borders 68 and snap-fit tabs 70 of bezel 7, and with rims 36, narrow peripheral first ribs 40, and wide peripheral second ribs 46 of crystal 3, thus make it possible to form a plurality of baffles enhancing the protection of the contents of case 1.

The invention also concerns a watch 100 including a case 1 of this type.

In short, the invention provides a bezel and crystal that can be dismantled, without using additional components either for stiffening the case middle or for collar the crystal. This solution generates cost savings and saves space.

What is claimed is:

1. A watch case comprising:

a case middle made of plastic or electroformed material;

a removable crystal; and a bezel to angularly secure said case middle and said crystal in a second angular holding position, wherein said crystal, or respectively said case middle, comprises a plurality of elbowed catches, each frontally insertable in a corresponding recess comprised in correspondence in said case middle or respectively in said crystal, in a first relative angular position between said case middle and said crystal called the first position of insertion or of removal, and each said catch being arranged to occupy, in said first angular position of insertion or of removal, a first pressed-in position when the distance between said case middle and said crystal is minimal, said case middle and said crystal being arranged to pivot in relation to each other, in said pressed-in first position of said catches, to the second angular holding position wherein a part of each catch is frontally locked behind a holding surface forming a safety catch comprised in said case middle or respectively in said crystal, and wherein said bezel is a separate piece from the case middle and the crystal that is attached to the case middle and the crystal by being frontally snap-fitted on said case middle and/or said crystal by snap-fit fingers comprised in said bezel and which are arranged to cooperate with at least one complementary stop surface, or with complementary snap-fit fingers, comprised in said case middle and/or said crystal.

2. The watch case according to claim 1, wherein said bezel is made of plastic material.

3. The watch case according to claim 1, wherein said bezel placed both on said case middle and on said crystal.

4. The watch case according to claim 1, wherein said crystal is back crystal.

5. The watch case according to claim 1, wherein said crystal is an opaque back cover.

6. The watch case according to claim 1, wherein said crystal is made of plastic material.

7. The watch case according to claim 1, wherein said second angular holding position is delimited by first angular stop means comprised in said case middle arranged to cooperate in abutment with complementary first angular stop means comprised in said crystal.

8. The watch case according to claim 1, wherein said bezel comprises second angular stop means arranged to cooperate in abutment with complementary second angular case middle stop means comprised in said case middle, and/or with complementary second angular crystal stop means comprised in said crystal.

9. The watch case according to claim 8, wherein the snap-fit fingers include lateral edges which form said second angular stop means and are arranged to cooperate in abutment with end surfaces comprised in said catches.

10. The watch case according to claim 1, wherein, in said pressed-in first position, when the distance between said case middle and said crystal is minimal, said case middle and said crystal together compress at least one sealing gasket housed in a groove comprised in said case middle and/or in said crystal.

11. A watch including a case according to claim 1.

12. The watch case according to claim 1, wherein each of the snap-fit fingers of the bezel is positioned in one of the recesses such that an edge of the snap-fit finger abuts an edge of the elbowed catch also positioned in the recess to angularly secure said case middle and said crystal in the second angular holding position.

* * * * *